US006048296A

United States Patent [19]

Futerman

[11] Patent Number: 6,048,296

[45] Date of Patent: Apr. 11, 2000

[54] METHOD OF MAKING A LINED BAG

[75] Inventor: Charles Sidney Futerman, London, United Kingdom

[73] Assignee: Reexam Mulox Limited, London, United Kingdom

[21] Appl. No.: 09/045,183

[22] Filed: Mar. 20, 1998

[30] Foreign Application Priority Data

Mar. 22, 1997 [GB] United Kingdom ..... 9706017

[51] Int. Cl.[7] ..... B31B 39/68; B31B 39/72

[52] U.S. Cl. ..... 493/217; 493/383; 493/933

[58] Field of Search ..... 493/217, 922, 493/95, 96, 383, 382, 933; 53/175

[56] References Cited

U.S. PATENT DOCUMENTS

| | | | |
|---|---|---|---|
| 3,803,991 | 4/1974 | Leader | 493/217 |
| 3,962,959 | 6/1976 | Williamson | 493/217 |
| 4,226,170 | 10/1980 | Christensson | 493/95 |
| 4,597,102 | 6/1986 | Nattrass | 383/105 |
| 4,636,189 | 1/1987 | Chen . | |
| 4,658,989 | 4/1987 | Bonerb | 222/105 |
| 4,917,266 | 4/1990 | Kellenberger et al. | 222/105 |
| 4,946,291 | 8/1990 | Schnaars | 383/113 |

FOREIGN PATENT DOCUMENTS

| | | |
|---|---|---|
| 0 483 980 A1 | 5/1992 | European Pat. Off. . |
| 1 591 091 | 6/1981 | United Kingdom . |
| 2 063 816 | 6/1981 | United Kingdom . |
| 2125769 | 3/1984 | United Kingdom . |

OTHER PUBLICATIONS

European Search Report, Application No. EP 98 20 0696, dated Feb. 7, 1998.

*Primary Examiner*—James F. Coan
*Attorney, Agent, or Firm*—Kohn & Associates

[57] ABSTRACT

A container bag having a base, side walls and lifting loops, the base having a reclosable bottom opening, characterised in that a liner is provided attached to the bag, the liner having a cone shaped lower portion. Preferably the liner is made from a lighter, and less expensive, material than the outer bag. Conveniently the liner is attached to the outer bag by means such as clips, adhesive or sewing, and may advantageously be sewn to the outer bag along the top thereof. Preferably the cone-shaped lower portion of the liner terminates in an opening which may be tied off, as is known in the FIBC art. The bottom closure of the outer bag may be a "petal" or "pyjama" closure, but advantageously is larger than may have been common hitherto. The cone-shaped lower portion of the liner will depend through the opening in the outer bag when the latter is untied.

3 Claims, 7 Drawing Sheets

METHOD OF MAKING A LINED BAG

This invention relates to container bags and in particular relates to container bags for carrying loads in the range of one half to two to tonnes and known as flexible intermediate bulk containers (FIBC's).

BACKGROUND OF THE INVENTION

Flexible intermediate bulk containers are increasingly employed in cargo handling and transporting situations, especially for the carriage of particulate or pulverulent material. A typical FIBC will be manufactured from a fabric woven from polyolefin tapes and have integral lifting loops. Examples of such containers are described in UK patent numbers 1 591 091 and 2 063 816. FIBC's have to meet various national and international safety standards; for example, it is normal to require 5:1 safety ratio, that is an FIBC rated at one tonne should not break under loads of less than five tonnes.

Some products are less free flowing than others and can tend to clog (variously known as to "bridge" or "rat hole" in the industry) during emptying of an FIBC. It has been proposed to produce FIBC's with a cone shaped base to facilitate emptying of such products but such FIBC's are relatively expensive both because they require more material and because different manufacturing methods must be employed for relatively small numbers of bags.

SUMMARY OF THE INVENTION

The invention seeks to provide a container bag improved in the above respects.

According to the present invention there is provided a container bag having a base, side walls and lifting loops, the base having a reclosable bottom opening, characterised in that a liner is provided attached to the bag, the liner having a cone shaped lower portion.

Preferably the liner is made from a lighter, and less expensive, material than the outer bag. Conveniently the liner is attached to the outer bag by means such as clips, adhesive or sewing, and may advantageously be sewn to the outer bag along the top thereof.

Preferably the cone-shaped lower portion of the liner terminates in an opening which may be tied off, as is known in the FIBC art. The bottom closure of the outer bag may be of the form known per se and referred to as a "petal" or "pyjama" closure, but advantageously is larger than may have been common hitherto. The cone-shaped lower portion of the liner will depend through the opening in the outer bag when the latter is untied.

The fabric from which the FIBC of the invention is formed, as well as the inner bag or liner, may be conventional fabrics for use in this type of container bag and may be woven from polyolefin, i.e. polyethylene or polypropylene, tape yarns. Preferably, as mentioned above, the liner or inner bag will be of a lighter material than that of the outer bag both to reduce weight and to save cost. The side walls of the FIBC may be made from a fabric having reinforced zones or areas of interwoven reinforcing yarns, for example as disclosed in UK patent number 1 591 091. Where such reinforcing areas are provided there may be as described in that patent and may be formed of interwoven threads of high tensile strength reinforcing yarns such as polyamide, polyester or twisted of fibrillated polypropylene. The lifting loops are attached to such reinforced areas. Alternatively, the FIBC may be "underslung" where the lifting loops extend down the side walls and under the base of the-container body. In either case the lifting loops will preferably be of a woven webbing of synthetic yarns, for instance of the type used for car seats belts, for example polyamide or polyester yarns, or made be ropes or hawsers of suitable strength.

It is preferred that four lifting loops be provided spaced across the corners of the bag. Corners will normally be defined by side seams, and this construction is preferred since it is roughly cubic in shape when filled and therefore stacks well.

The container bag of the invention may be fitted with a top and/or a filling spout as well as the discharge means discussed above.

In order to locate the liner or inner bag within the outer it is preferred to place the liner over a former, place one or more, preferably four, lengths of double sided adhesive tape about the base of the liner, and place the outer bag over the liner causing the adhesive tape to locate the outer and inner in the correct relative positions. This ensures that when the bag is filled with product, the latter extends right down into the bottom edges and corners of the FIBC giving it the advantageous "square" shape referred to above rather than a rounded base which is difficult to stack. However, when the bottom closure of the outer bag is opened, the cone shaped lower portion of the inner falls away from the sides and allows the product to flow freely, facilitating complete discharge.

BRIEF DESCRIPTION OF THE DRAWINGS

The invention will be described further, by way of example, with reference to the accompanying drawings, in which.

DETAILED DESCRIPTION OF THE PREFERRED EMBODIMENTS

Figure 1:
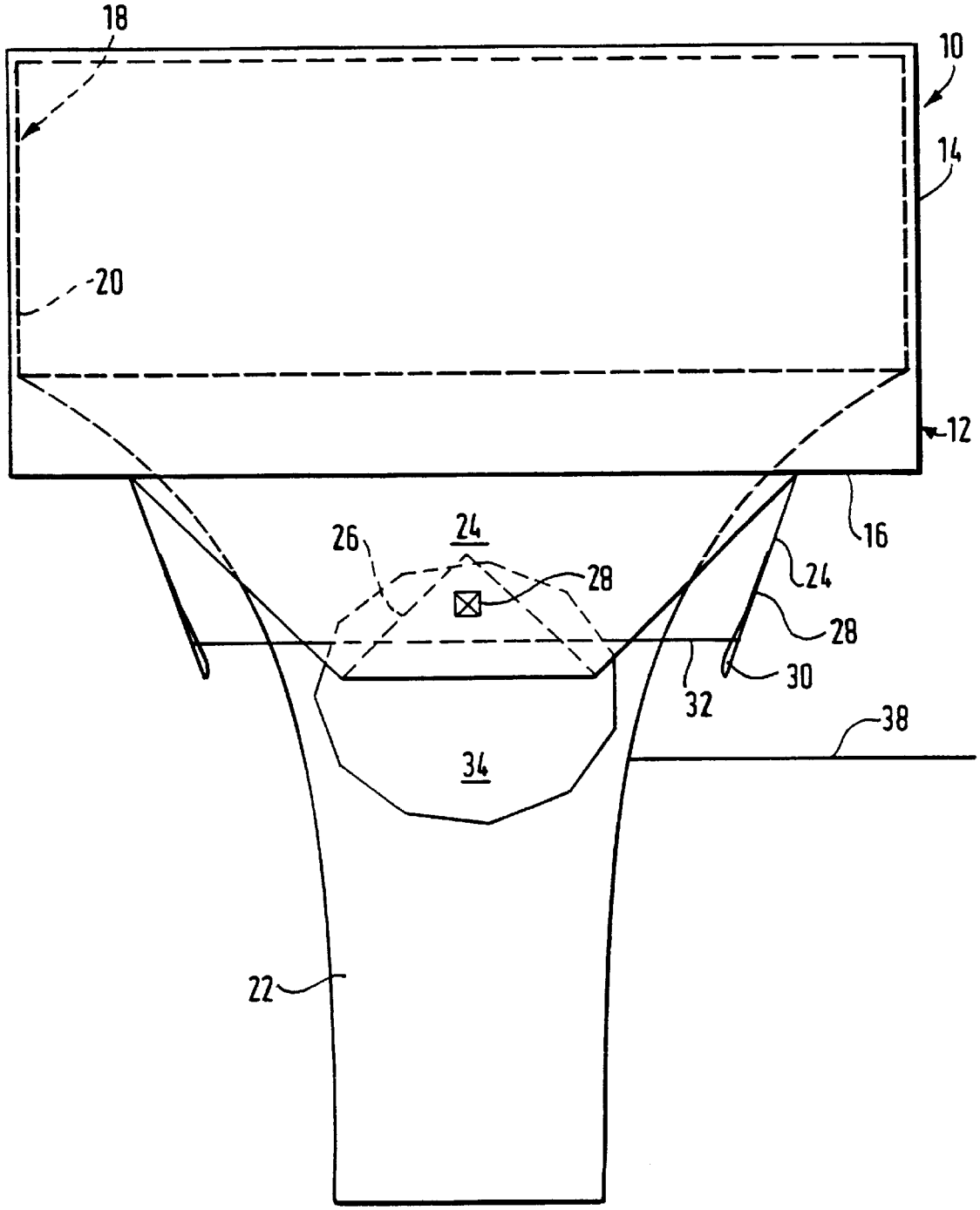
FIG. 1 is a partial diagrammatic sectional view of an FIBC constructed in accordance with the invention.
Figure 2:
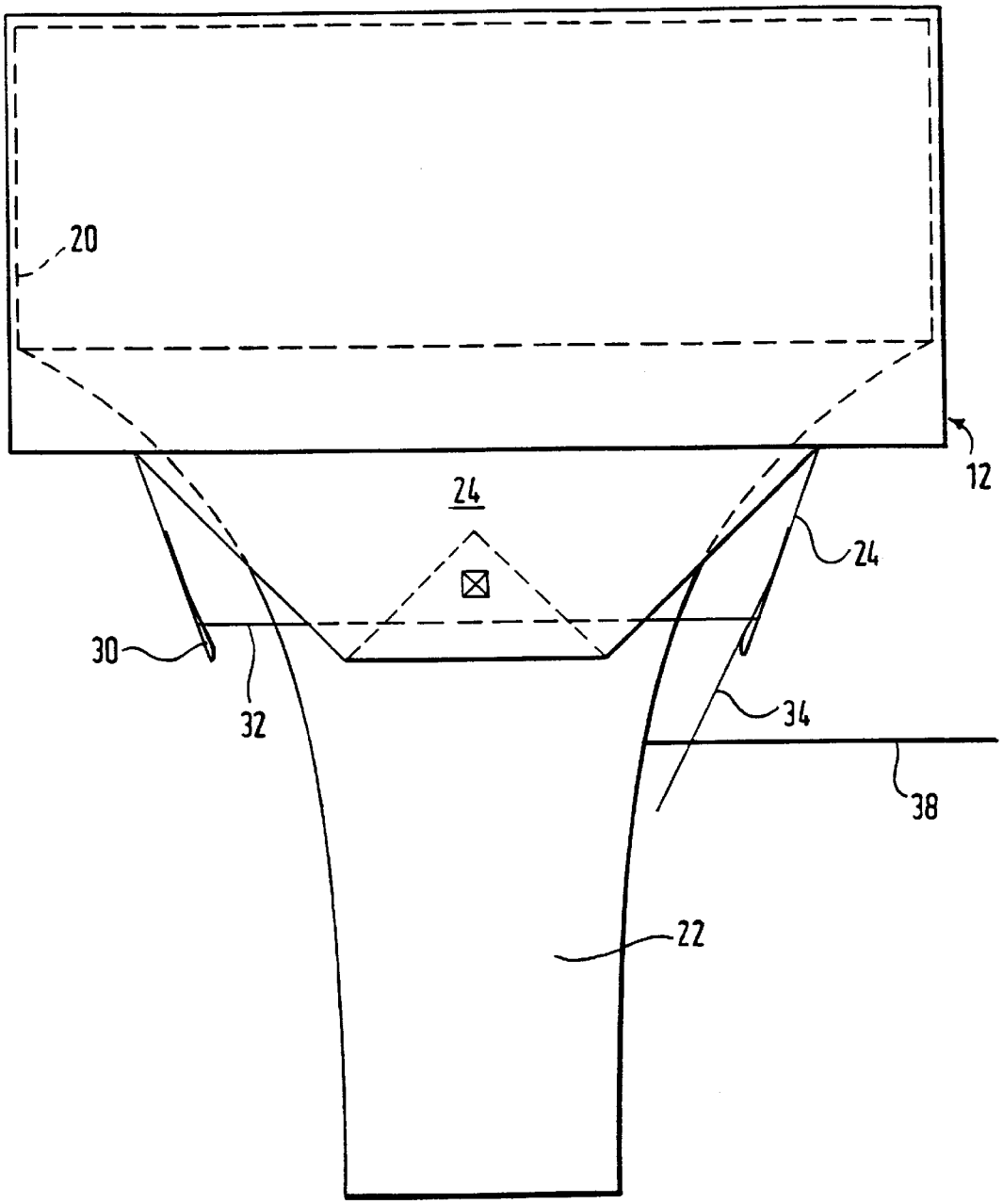
FIG. 2 is a similar view to FIG. 1 rotated through 90°.

Referring to the drawings, a flexible intermediate bulk container bag generally designated 10 comprises an outer bag 12 having side walls 14 and a base 16. Within the outer bag 12 is an inner bag or liner 18 which itself has side walls 20 and a generally conical base 22. The upper portion of the side walls 20 of the inner is attached to the upper portion of the side walls 14 of the outer bag 12 by means of stitching, clips, or the like.

Figure 3:
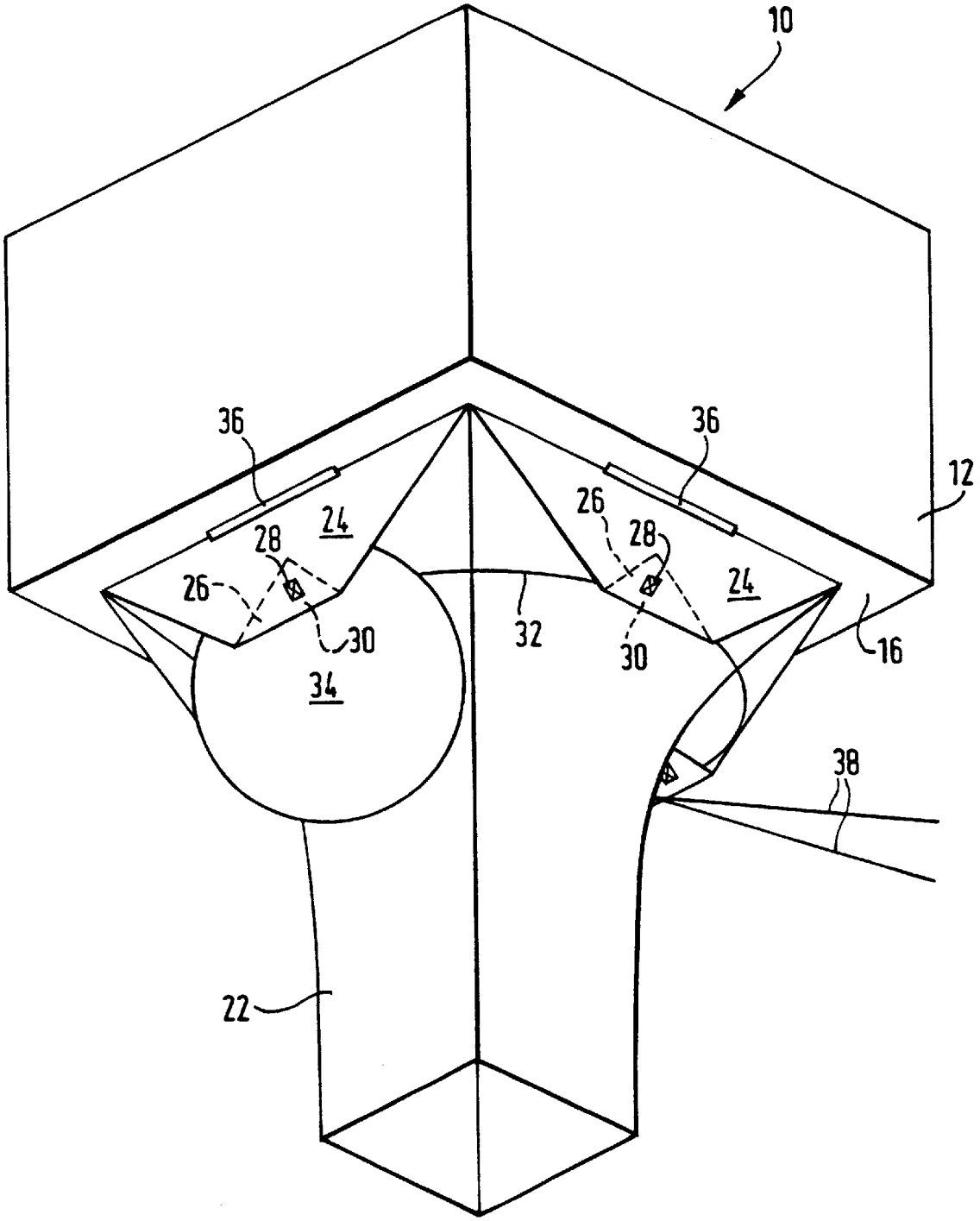
FIG. 3 is a diagrammatic perspective view of an FIBC of the invention fully opened.

The central portion of the base 16 of the outer bag 12 is cut to form four triangular flaps 24, the top ends 26 of which are folded back on the rest of the flap 24 and stitched to the main flap portion at 28. The pocket 30 so formed carries a tie cord 32. Attached to one of the flaps 24 is a disc 34, which is shown as round in FIG. 3 and as polygonal in FIG. 1 but which could be of any suitable shape, e.g. square. The purpose of the disc 34 is to protect the bottom of the conical spout 22 when the closure of the outer bag is closed as will be explained more fully hereinafter.

Looking now at FIGS. 3–6, the formation of the FIBC of the invention will be discussed. An inner bag 18 is placed on a generally cubic former (not shown) and the base aligned with the top of the former. An outer bag 12 is then placed over the inner and former and its base 16 aligned with the base of the inner bag 18. Strips of double sided adhesive tape 36 are positioned on the inside of the base 16 of the outer bag 12 adjacent the flaps 24 and these adhere to the base of the inner bag 18 and help locate the two bags with respect to one another.

Figure 4:
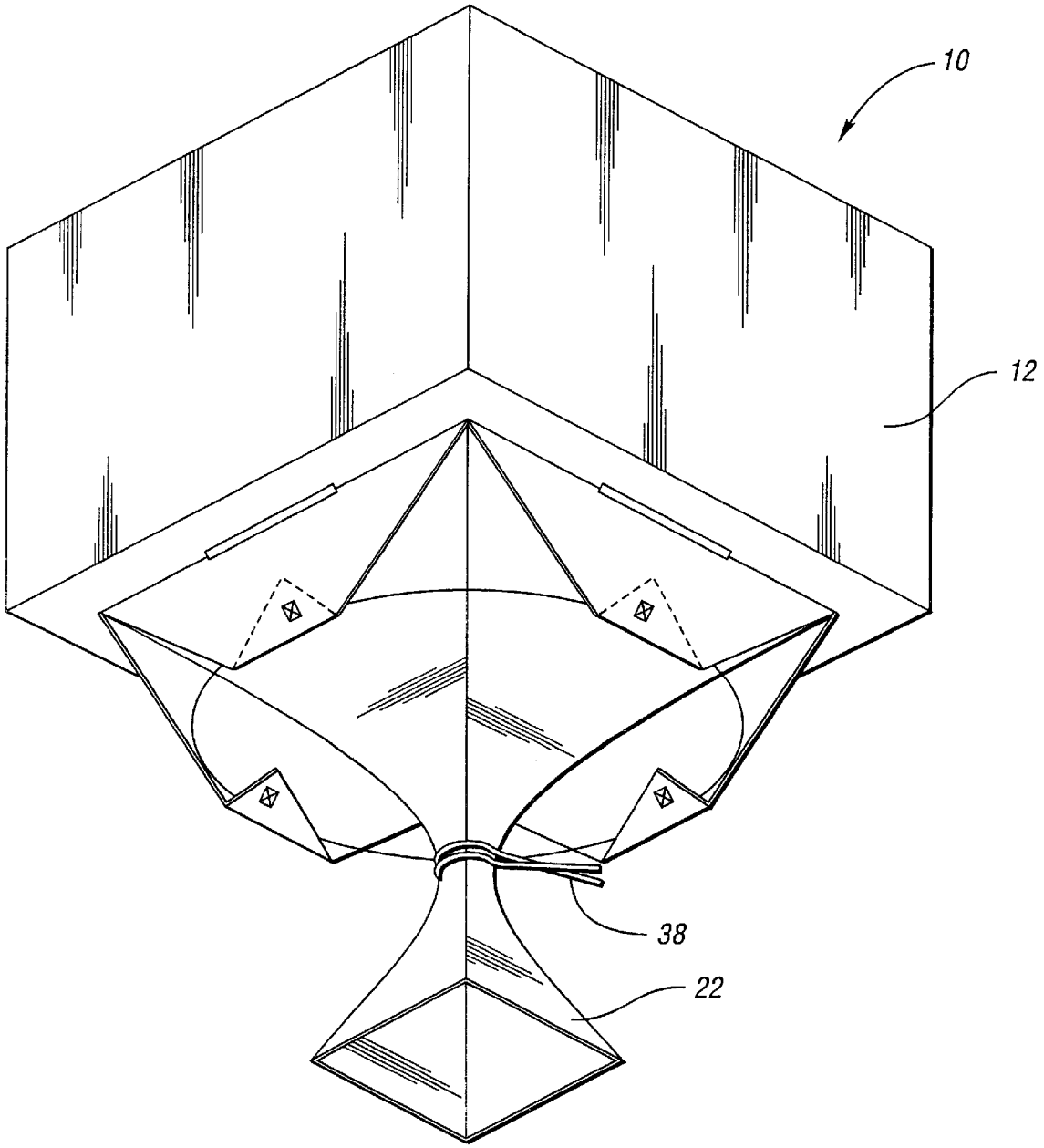
FIGS. 4–6 illustrate progressive stages in the closing of the base.
Figure 5:
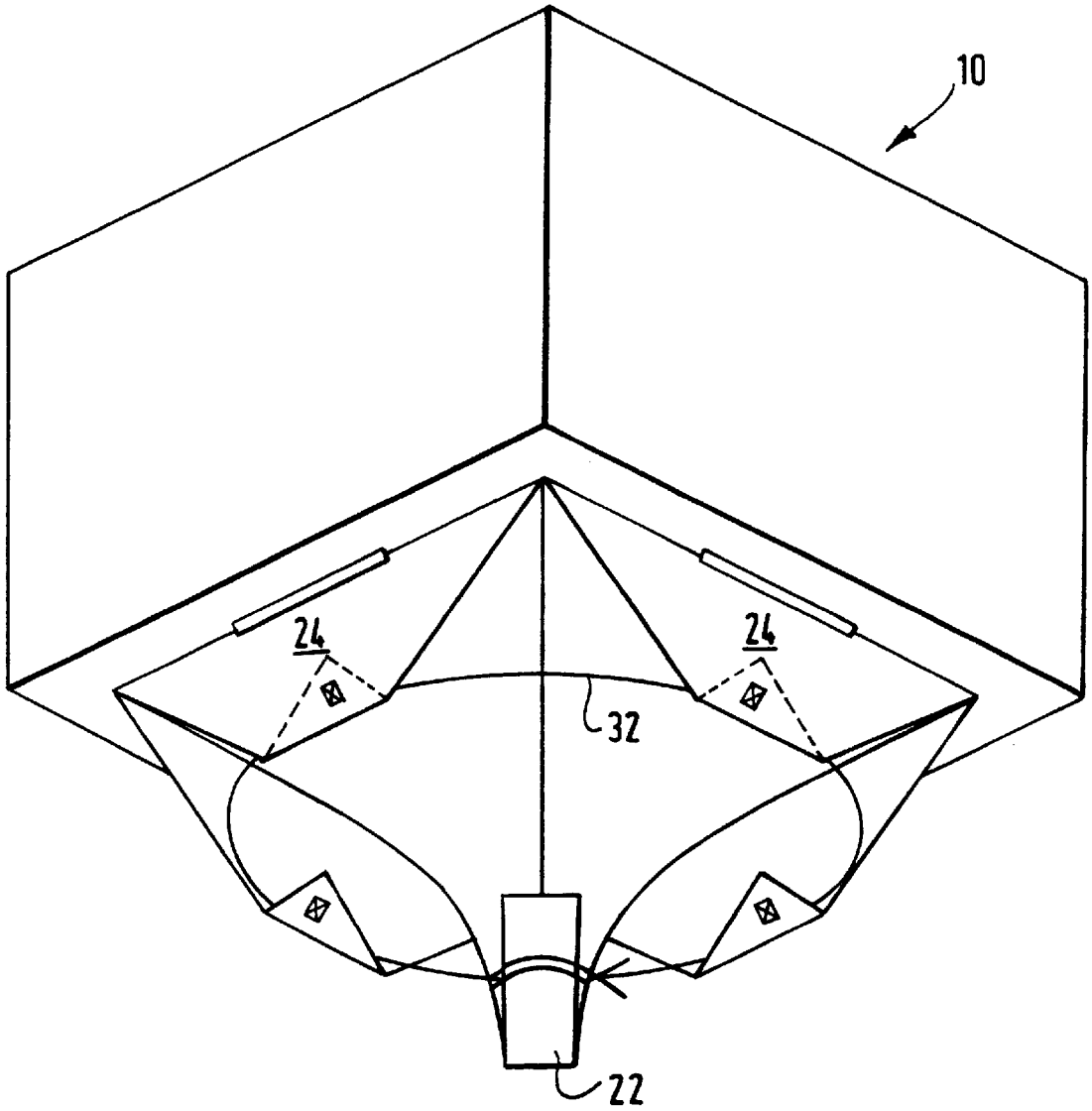
Figure 6:
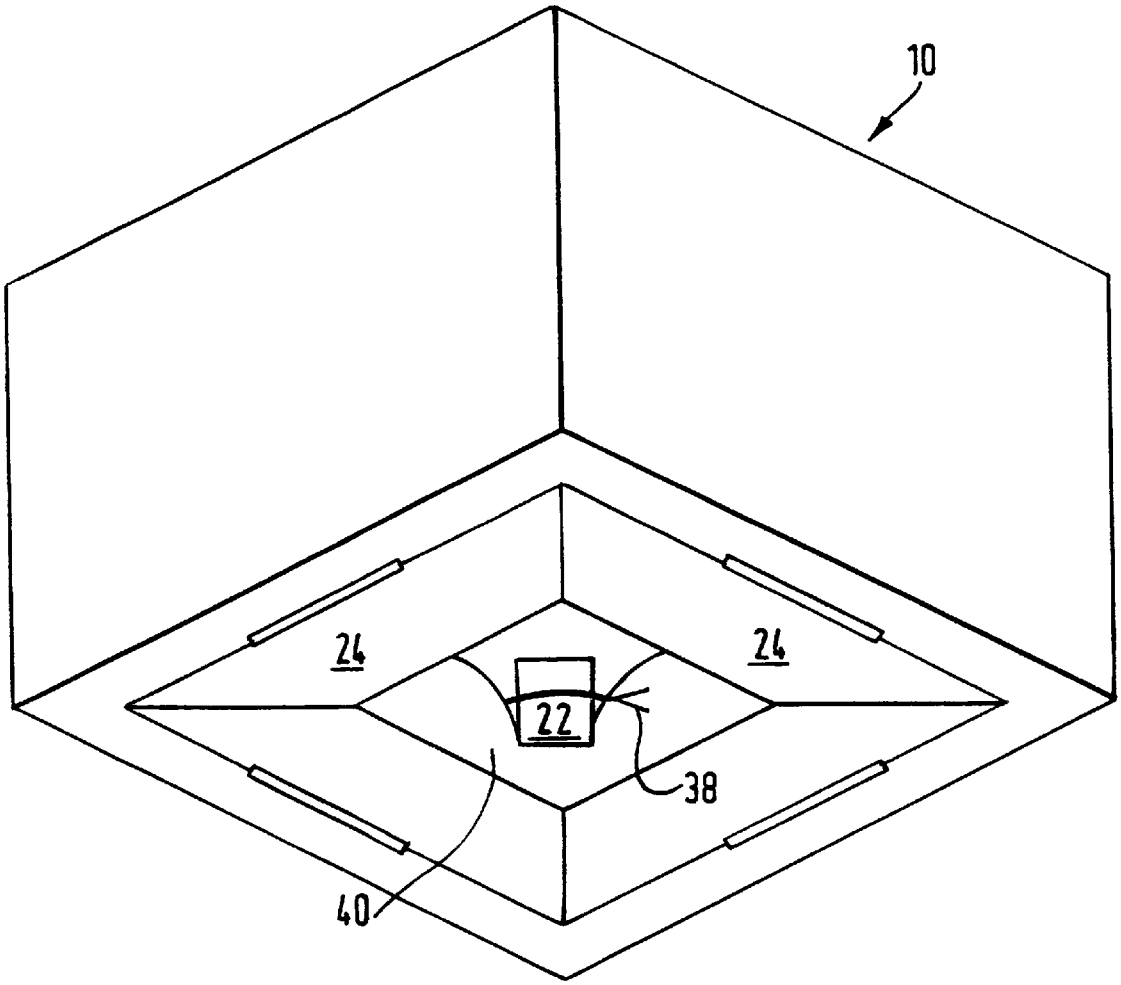
Figure 7:
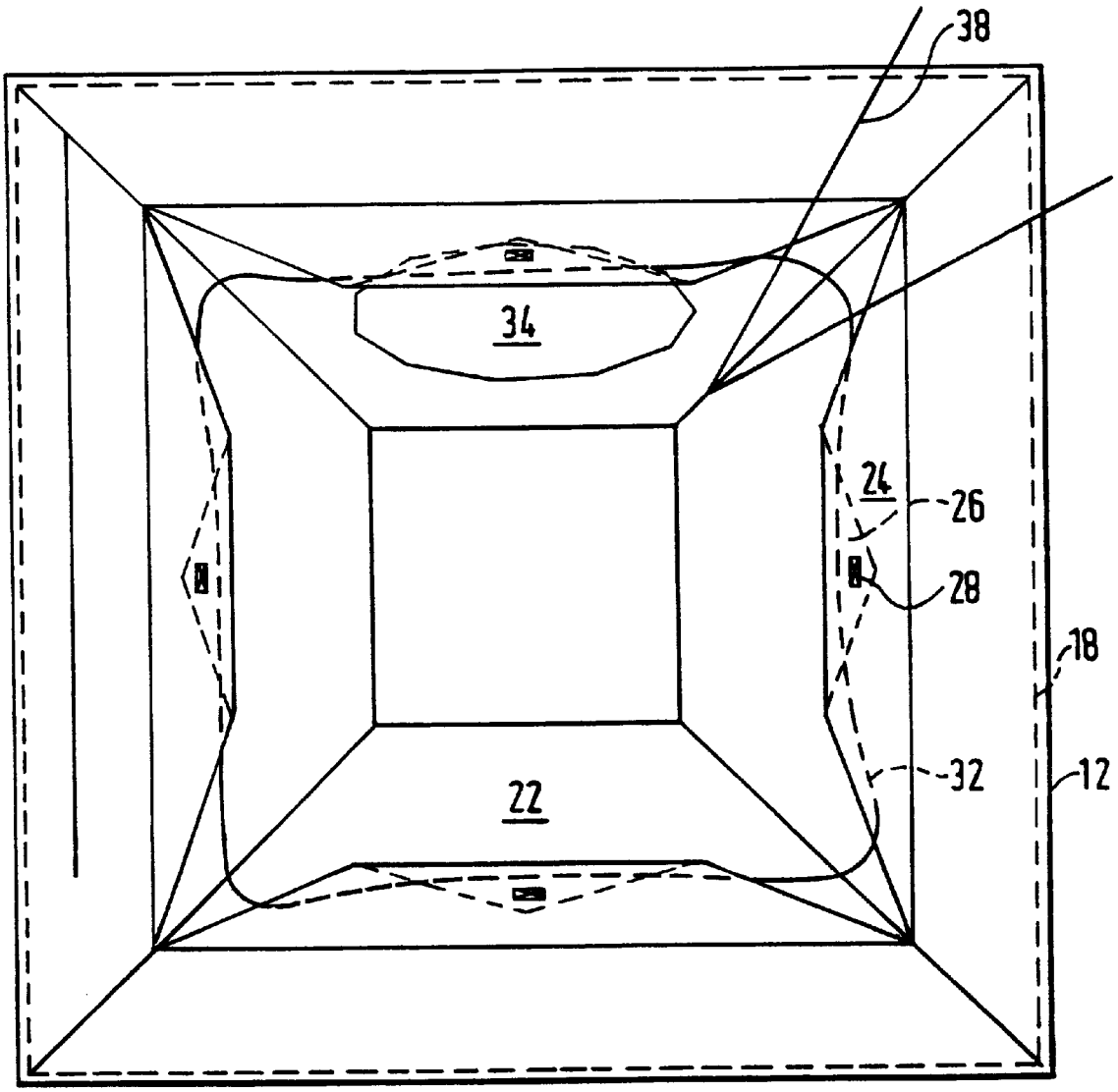
FIG. 7 is a bottom view of the FIBC of the invention.

The bags are then taken off the former and the top edges of the inner and outer sewn together. The combined bag is then hung in the position shown in FIG. 3 when the conical spout 22 of the inner bag depends through the open closure in the base 16 of the outer bag 12. Tie cords 38 are provided to tie off the conical portion 22 of the inner bag 18 as shown in FIG. 4. The base portion 22 is then folded up as shown in FIGS. 5 and 6 until it is within the closure on the base of the outer bag at which point the tie string 32 is pulled tight causing the flaps 24 to be pulled up to the configuration illustrated in FIG. 6. Although omitted from FIG. 6 for clarity, the disc 34 will fill the central opening 40 between the flaps 24 and cover the base 22 of the inner bag 18. In this position, the bag is ready for filling and subsequent use.

Discharging a filled bag is the reverse of the above procedure. The bag having the configuration very much as shown in FIG. 6 has the discharge cord 32 released so that the flaps 24 fall open after which the cone shaped portion 22 will fall downwardly through the opening so made and fill with material. Releasing the cord 38 allows the material to be discharged through the conical portion 22 to a suitable receptacle.

The configuration of the FIBC of the invention has several advantages. The inner bag 18 may be manufactured from a lighter and less expensive material. The outer bag 12 may be of standard FIBC construction, and thus a small stock of inner bags 18 may be maintained and used with the standard outer bag to produce the FIBC of the invention very economically. The method of assembly is much faster and lower cost than hitherto proposed cone based FIBC's.

I claim:

1. A method of making a bag which comprises placing a liner over a former, placing one or more lengths of double sided adhesive tape about the base of the liner, and placing an outer bag over the liner causing the adhesive tape to locate the outer bag and inner liner in correct relative positions.

2. A method as claimed in claim 1 wherein four lengths of adhesive tape are employed.

3. A method as claimed in claim 1, further comprising taking the bag off the former, and sewing the top edges of the inner liner and outer bag together to fixedly attach the inner liner and outer bag.

* * * * *